US006620005B1

(12) United States Patent
Butz

(10) Patent No.: US 6,620,005 B1
(45) Date of Patent: Sep. 16, 2003

(54) REMOTELY CONTROLLED STEERING TRANSOM

(76) Inventor: Wayne P. Butz, 4033 Powder View Cir., West Valley City, UT (US) 84128

( * ) Notice: Subject to any disclaimer, the term of this patent is extended or adjusted under 35 U.S.C. 154(b) by 0 days.

(21) Appl. No.: 10/211,057

(22) Filed: Aug. 2, 2002

(51) Int. Cl.[7] ..... B63H 5/125
(52) U.S. Cl. ..... 440/62; 114/144 R
(58) Field of Search ..... 114/144 R, 160; 248/640–642; 440/53, 62

(56) References Cited

U.S. PATENT DOCUMENTS 3,968,768 A 7/1976 Solt
3,989,000 A 11/1976 Foley, Jr.
4,820,208 A 4/1989 Phillips
5,112,256 A 5/1992 Clement
5,171,173 A 12/1992 Henderson et al.
5,603,505 A * 2/1997 Acock ..... 273/291
5,954,551 A 9/1999 King
D418,521 S 1/2000 Hansen

* cited by examiner

*Primary Examiner*—Ed Swinehart

(57) ABSTRACT

A remotely controlled steering transom for attaching to the existing transom of a boat thereby allowing the user to control the boat motor remotely from any location in the boat. The remotely controlled steering transom includes an electrically driven transom for steering outboard boat motors that utilizes a multiple pulley system, the transom being remotely operated from anywhere in the boat.

9 Claims, 3 Drawing Sheets

REMOTELY CONTROLLED STEERING TRANSOM

BACKGROUND OF THE INVENTION

1. Field of the Invention

The present invention relates to remotely controlled steering transoms and more particularly pertains to a new remotely controlled steering transom for attaching to the existing transom of a boat thereby allowing the user to control the boat motor remotely from any location in the boat.

2. Description of the Prior Art

The use of remotely controlled steering transoms is known in the prior art. More specifically, remotely controlled steering transoms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,968,768; U.S. Pat. No. 4,820,208; U.S. Pat. No. 5,171,173; U.S. Pat. No. 3,989,000; U.S. Pat. No. 5,954,551; U.S. Pat. No. 5,112,256; and U.S. Pat. No. Des. 418,521.

While these devices fulfill their respective, particular objectives and requirements, the aforementioned patents do not disclose a new remotely controlled steering transom. The inventive device includes an electrically driven transom for steering outboard boat motors that utilizes a multiple pulley system, the transom being remotely operated from anywhere in the boat.

In these respects, the remotely controlled steering transom according to the present invention substantially departs from the conventional concepts and designs of the prior art, and in so doing provides an apparatus primarily developed for the purpose of attaching to the existing transom of a boat thereby allowing the user to control the boat motor remotely from any location in the boat.

SUMMARY OF THE INVENTION

In view of the foregoing disadvantages inherent in the known types of remotely controlled steering transoms now present in the prior art, the present invention provides a new remotely controlled steering transom construction wherein the same can be utilized for attaching to the existing transom of a boat thereby allowing the user to control the boat motor remotely from any location in the boat.

The general purpose of the present invention, which will be described subsequently in greater detail, is to provide a new remotely controlled steering transom apparatus and method which has many of the advantages of the remotely controlled steering transoms mentioned heretofore and many novel features that result in a new remotely controlled steering transom which is not anticipated, rendered obvious, suggested, or even implied by any of the prior art remotely controlled steering transoms, either alone or in any combination thereof.

To attain this, the present invention generally comprises an electrically driven transom for steering outboard boat motors that utilizes a multiple pulley system, the transom being remotely operated from anywhere in the boat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new remotely controlled steering transom apparatus and method which has many of the advantages of the remotely controlled steering transoms mentioned heretofore and many novel features that result in a new remotely controlled steering transom which is not anticipated, rendered obvious, suggested, or even implied by any of the prior art remotely controlled steering transoms, either alone or in any combination thereof.

It is another object of the present invention to provide a new remotely controlled steering transom which may be easily and efficiently manufactured and marketed.

It is a further object of the present invention to provide a new remotely controlled steering transom which is of a durable and reliable construction.

An even further object of the present invention is to provide a new remotely controlled steering transom which is susceptible of a low cost of manufacture with regard to both materials and labor and which accordingly is then susceptible of low prices of sale to the consuming public, thereby making such remotely controlled steering transom economically available to the buying public.

Still yet another object of the present invention is to provide a new remotely controlled steering transom which provides in the apparatuses and methods of the prior art some of the advantages thereof, while simultaneously overcoming some of the disadvantages normally associated therewith.

Still another object of the present invention is to provide a new remotely controlled steering transom for attaching to the existing transom of a boat thereby allowing the user to control the boat motor remotely from any location in the boat.

Yet another object of the present invention is to provide a new remotely controlled steering transom which includes an electrically driven transom for steering outboard boat motors that utilizes a multiple pulley system, the transom being remotely operated from anywhere in the boat.

Still yet another object of the present invention is to provide a new remotely controlled steering transom that, by means of a multiple pulley system, is able to control larger outboard boat motors.

Even still another object of the present invention is to provide a new remotely controlled steering transom that is couplable to a variety of boat and transom configurations.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
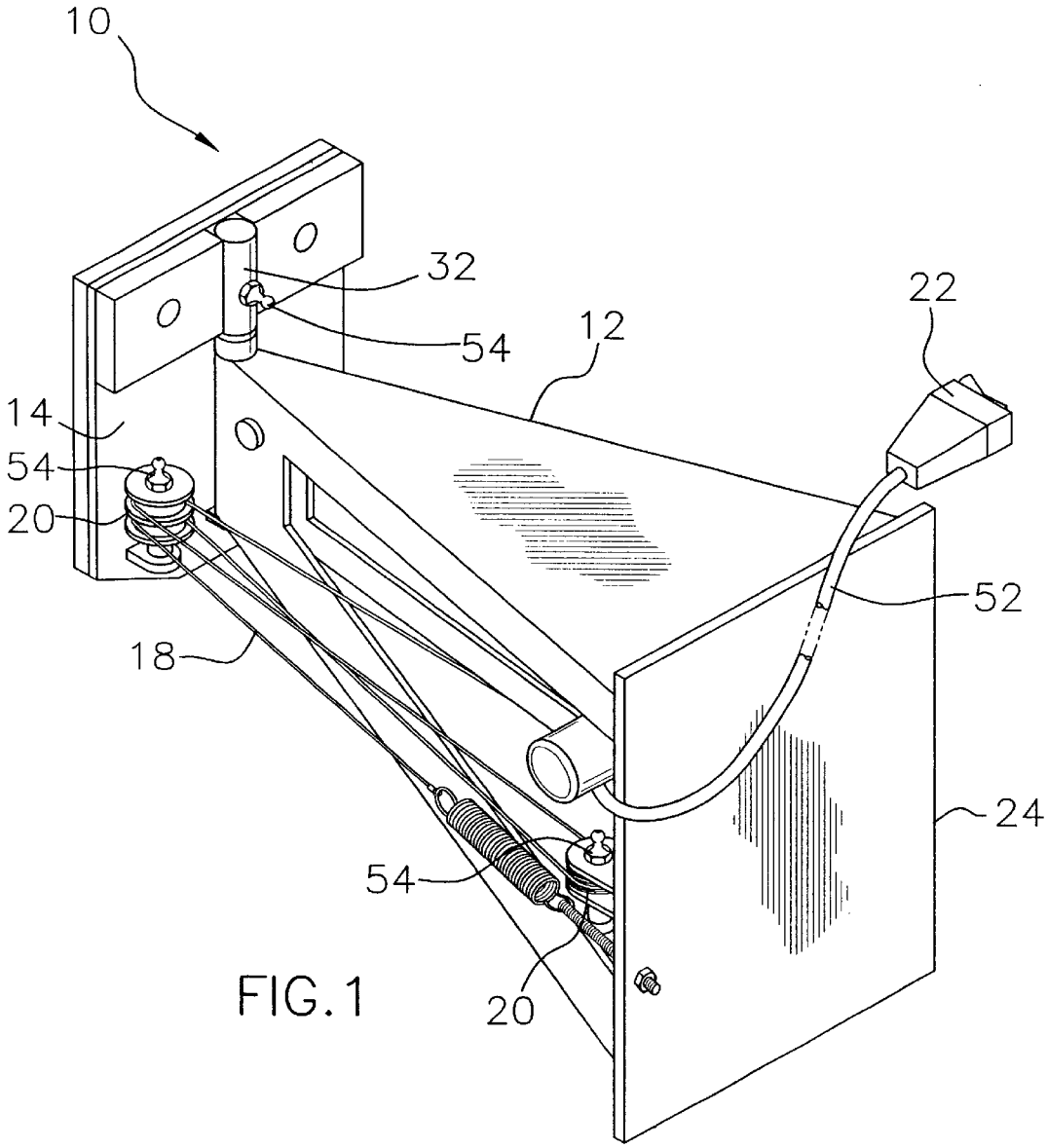
FIG. 1 is a schematic perspective view of a new remotely controlled steering transom according to the present invention.
Figure 2:
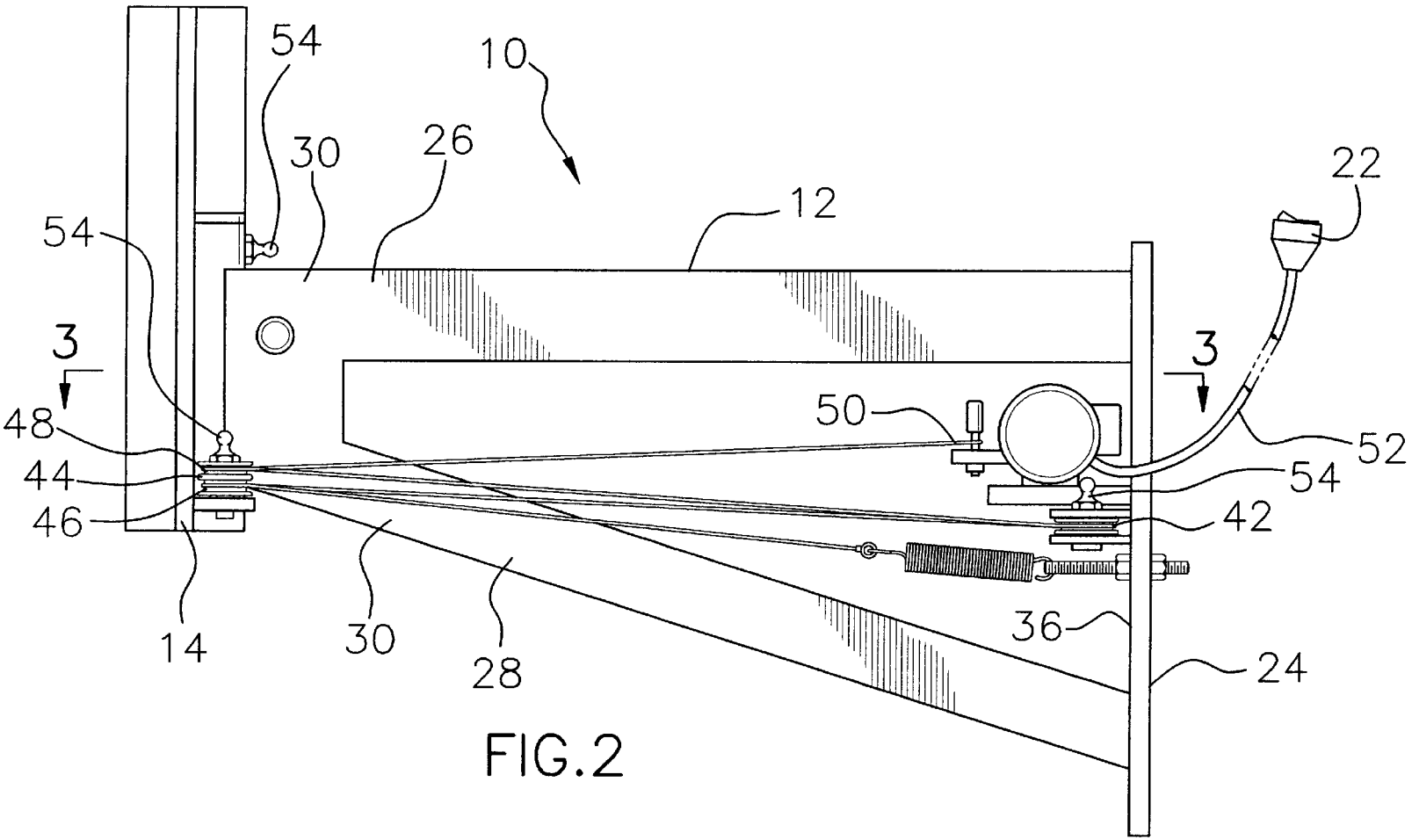
FIG. 2 is a schematic side view of the present invention.
Figure 3:
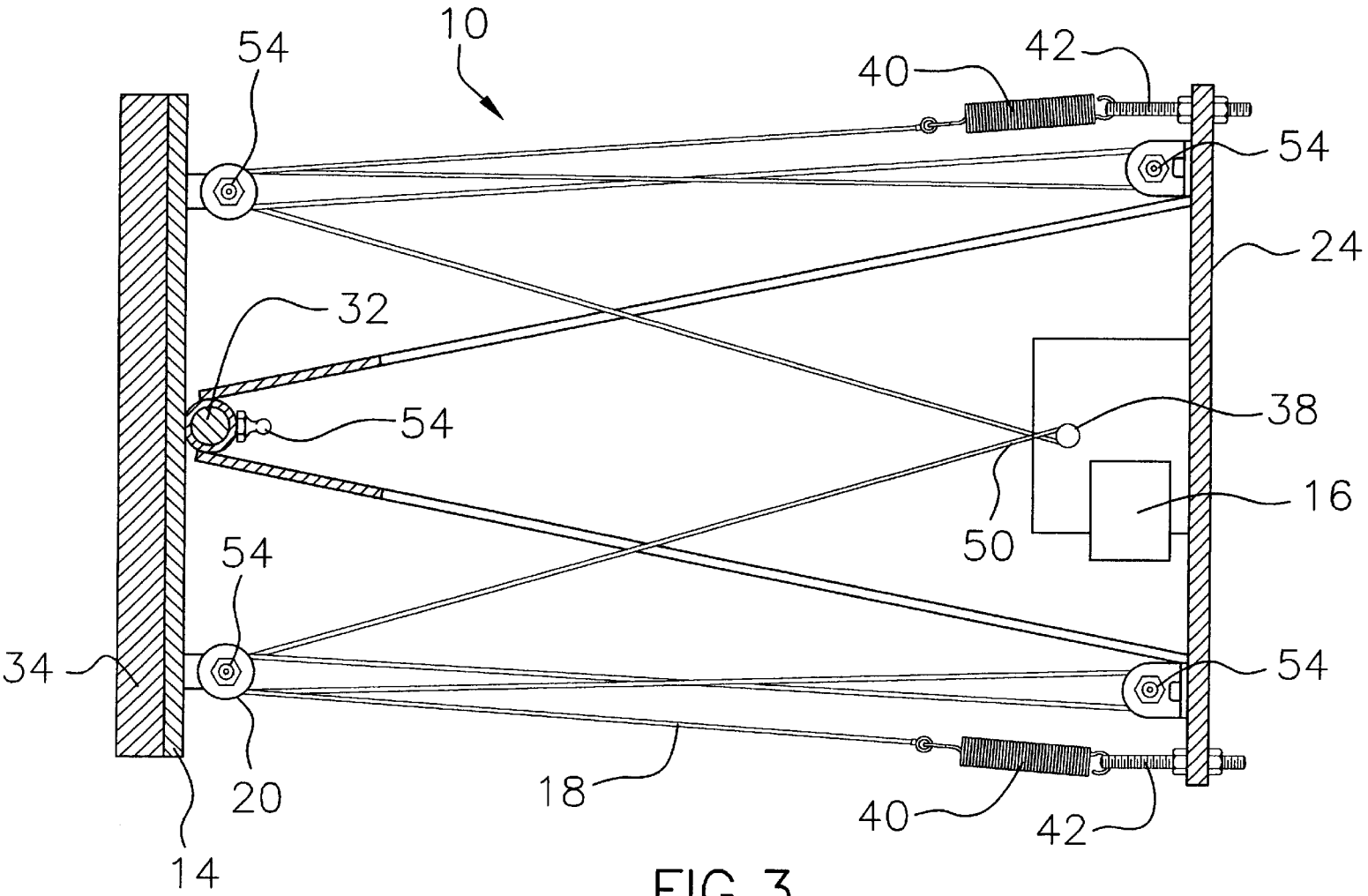
FIG. 3 is a schematic top view of the present invention.

With reference now to the drawings, and in particular to FIGS. 1 through 3 thereof, a new remotely controlled steering transom embodying the principles and concepts of the present invention and generally designated by the reference numeral 10 will be described.

As best illustrated in FIGS. 1 through 3, the remotely controlled steering transom 10 generally comprises a frame 12 designed for coupling to a transom of a boat. The frame 12 includes a motor mounting plate 14. The motor mounting plate 14 is pivotally coupled to the frame 12 and a boat motor is couplable to the motor mounting plate 14.

A reversible electric motor 16 is fixedly coupled to the frame 12 for biasing a flexible cable 18. The flexible cable 18 is coupled to the motor mounting plate 14 through a series of pulleys 20 such that when the reversible electric motor 16 is operated in response to a remote double acting switch 22, the motor mounting plate 14 is pivoted thereby remotely steering the boat.

The frame 12 comprises a transom mounting plate 24. Top and bottom plates 26, 28 are coupled to the transom mounting plate 24. Each of the plates extend rearwardly and are coupled at the rear most portions 30 thereof to a tubular bearing support 32.

The bottom plate 28 is coupled to the transom mounting plate 24 and extends both rearwardly and upwardly.

The top and bottom plates 26, 28 extend rearwardly and inwardly and are substantially triangular in shape.

The motor mounting plate 14 is fixedly coupled to the tubular bearing support 32 such that the motor mounting plate 14 is pivotable about a vertical axis of the tubular bearing support 32.

The motor mounting plate 14 includes wooden members 34 that are fixedly coupled to the motor mounting plate 14 for facilitating the mounting of the boat motor.

The reversible electric motor 16 is operationally coupled to a battery. The reversible electric motor 16 is fixedly coupled to a rear face 36 of the transom mounting plate 24 and interconnected with a motor driven pulley 38.

Each of a pair of tension springs 40 is coupled to an adjustable eyebolt 41 which is coupled to the transom mounting plate 24 on either side of the reversible electric motor 16.

Each of a pair of single pulley members 42 is coupled to the transom mounting plate 24 on either side of the reversible electric motor 16.

Each of a pair of double pulley members 44 is coupled to the motor mounting plate 14 on either side of the tubular bearing support 32 facing the tension springs 40.

The flexible cable 18 is coupled at each end to the tension springs 40. The cable passes around a lower pulley member 46 of the double pulley members 44 from an outside to an inside relationship, then around the single pulley members 42 from an outside to an inside relationship, then around an upper pulley member 48 of the double pulley members 44 from an outside to an inside relationship.

A portion of the flexible cable 50 between the pulleys is looped around the motor driven pulley 38 such that when the reversible electric motor 16 is operated in response to the double acting switch 22, the flexible cable 18 will be frictionally moved around the motor driven pulley 38 thereby causing the motor mounting plate 14 to rotate about the tubular bearing support 32 thereby steering the boat when the boat motor is attached to the motor mounting plate 14.

The motor driven pulley 38, tension springs 40, single pulley members 42, and double pulley members 44 are in approximately the same horizontal plane.

The double acting switch 22 is operationally coupled to the reversible electric motor 16. The double acting switch 22 and reversible electric motor 16 include a connecting cable 52. The connecting cable 52 is of sufficient length to allow the user to actuate the reversible electric motor 16 by actuation of the double acting switch 22 from any position within the boat to be steered.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A remotely controlled steering transom for outboard motors, the remotely controlled steering transom comprising:

a frame being adapted for being selectively couplable to a transom of a boat, said frame including a motor mounting plate, said motor mounting plate being pivotally coupled to said frame such that a boat motor is couplable to said motor mounting plate;

a reversible electric motor, said reversible electric motor being fixedly coupled to said frame for biasing a flexible cable, said flexible cable being coupled to said motor mounting plate through a series of pulleys such that when said reversible electric motor is operated in response to a remote double acting switch, said motor mounting plate is pivoted thereby remotely steering the boats;

said frame comprising a transom mounting plate, top and bottom plates coupled to said transom mounting plate each of which extend rearwardly being coupled at the rear most portions thereof to a tubular bearing support;

a pair of tension springs, each of said pair of tension springs being coupled to an adjustable eyebolt, said adjustable eyebolt being coupled to said transom mounting plate on either side of said reversible electric motor such that the tension on said springs is adjustable; and a pair of single pulley members, each of said pair of single pulley members being coupled to said transom mounting plate on either side of said reversible electric motor.

2. The remotely controlled steering transom as set forth in claim 1, further comprising:

said bottom plate coupled to said transom mounting plate extends both rearwardly and upwardly; and said top and bottom plates extend rearwardly and inwardly being substantially triangular in shape.

3. The remotely controlled steering transom as set forth in claim 1, further comprising:

said motor mounting plate being fixedly coupled to said tubular bearing support such that said motor mounting plate is pivotable about a vertical axis of said tubular bearing support; and said motor mounting plate including wooden members being fixedly coupled to said motor mounting plate for facilitating the mounting of the boat motor.

4. The remotely controlled steering transom as set forth in claim 1, further comprising:

said reversible electric motor being operationally coupled to a battery, said reversible electric motor being fixedly coupled to a rear face of said transom mounting plate and interconnected with a motor driven pulley.

5. The remotely controlled steering transom as set forth in claim 1, further comprising:

a pair of double pulley members, each of said pair of double pulley members being coupled to said motor mounting plate on either side of said tubular bearing support facing said tension springs.

6. The remotely controlled steering transom as set forth in claim 5, further comprising:

said flexible cable being coupled at each end to said tension springs, said cable passing around a lower pulley member of said double pulley members from an outside to an inside relationship then around said single pulley members from an outside to an inside relationship then around an upper pulley member of said double pulley members from an outside to an inside relationship; and a portion of said flexible cable between said pulleys being looped around said motor driven pulley such that when said reversible electric motor is operated in response to said double action switch, said flexible cable will be frictionally moved around said motor driven pulley thereby causing said motor mounting plate to rotate about said tubular bearing support thereby steering the boat when the boat motor is attached to said motor mounting plate.

7. The remotely controlled steering transom as set forth in claim 6, further comprising:

said motor driven pulley, tension springs, single pulley members, and double pulley members are in approximately the same horizontal plane.

8. The remotely controlled steering transom as set forth in claim 1, further comprising:

said double acting switch being operationally coupled to said reversible electric motor, said double acting switch and reversible electric motor including a connecting cable, said connecting cable being of sufficient length to allow the user to actuate said reversible electric motor by actuation of said double acting switch from any position within the boat to be steered.

9. A remotely controlled steering transom for outboard motors, the remotely controlled steering transom comprising:

a frame being adapted for being selectively couplable to a transom of a boat, said frame including a motor mounting plate, said motor mounting plate being pivotally coupled to said frame such that a boat motor is couplable to said motor mounting plate;

a reversible electric motor, said reversible electric motor being fixedly coupled to said frame for biasing a flexible cable, said flexible cable being coupled to said motor mounting plate through a series of pulleys such that when said reversible electric motor is operated in response to a remote double acting switch, said motor mounting plate is pivoted thereby remotely steering the boat;

said frame comprising a transom mounting plate, top and bottom plates coupled to said transom mounting plate each of which extend rearwardly being coupled at the rear most portions thereof to a tubular bearing support;

said bottom plate coupled to said transom mounting plate extends both rearwardly and upwardly;

said top and bottom plates extend rearwardly and inwardly being substantially triangular in shape;

said motor mounting plate being fixedly coupled to said tubular bearing support such that said motor mounting plate is pivotable about a vertical axis of said tubular bearing support;

said motor mounting plate including wooden members being fixedly coupled to said motor mounting plate for facilitating the mounting of the boat motor;

said reversible electric motor being operationally coupled to a battery, said reversible electric motor being fixedly coupled to a rear face of said transom mounting plate and interconnected with a motor driven pulley;

a pair of tension springs, each of said pair of tension springs being coupled to an adjustable eyebolt, said adjustable eyebolt being coupled to said transom mounting plate on either side of said reversible electric motor such that the tension on said springs is adjustable;

a pair of single pulley members, each of said pair of single pulley members being coupled to said transom mounting plate on either side of said reversible electric motor;

a pair of double pulley members, each of said pair of double pulley members being coupled to said motor mounting plate on either side of said tubular bearing support facing said tension springs;

said flexible cable being coupled at each end to said tension springs, said cable passing around a lower pulley member of said double pulley members from an outside to an inside relationship then around said single pulley members from an outside to an inside relationship then around an upper pulley member of said double pulley members from an outside to an inside relationship;

a portion of said flexible cable between said pulleys being looped around said motor driven pulley such that when said reversible electric motor is operated in response to said double action switch, said flexible cable will be frictionally moved around said motor driven pulley thereby causing said motor mounting plate to rotate about said tubular bearing support thereby steering the boat when the boat motor is attached to said motor mounting plate;

said motor driven pulley, tension springs, single pulley members, and double pulley members are in approximately the same horizontal plane;

said double acting switch being operationally coupled to said reversible electric motor, said double acting switch and reversible electric motor including a connecting cable, said connecting cable being of sufficient length to allow the user to actuate said reversible electric motor by actuation of said double acting switch from any position within the boat to be steered.

* * * * *